US007801473B2

(12) United States Patent
Ando

(10) Patent No.: US 7,801,473 B2
(45) Date of Patent: Sep. 21, 2010

(54) FIXING DEVICE, IMAGE FORMING APPARATUS AND FIXING METHOD

(75) Inventor: Chikara Ando, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 147 days.

(21) Appl. No.: 12/170,973

(22) Filed: Jul. 10, 2008

(65) Prior Publication Data

US 2009/0116885 A1 May 7, 2009

(30) Foreign Application Priority Data

Nov. 7, 2007 (JP) ..... 2007-290206

(51) Int. Cl.
*G03G 15/20* (2006.01)

(52) U.S. Cl. ..... 399/323; 399/329; 399/331

(58) Field of Classification Search ..... 399/323, 399/322, 329, 331; 430/124.1, 124.3; 347/156
See application file for complete search history.

(56) References Cited

U.S. PATENT DOCUMENTS

| | | | | |
|---|---|---|---|---|
| 5,130,754 | A * | 7/1992 | Hishikawa | 399/322 |
| 6,775,509 | B2 * | 8/2004 | Shida et al. | 399/331 X |
| 2007/0048035 | A1 * | 3/2007 | Baba et al. | 399/323 |
| 2007/0048042 | A1 | 3/2007 | Uehara et al. | 399/329 |
| 2007/0065189 | A1 * | 3/2007 | Miyata et al. | 399/323 |
| 2008/0013993 | A1 * | 1/2008 | Obata et al. | 399/331 |
| 2008/0124146 | A1 * | 5/2008 | Bae et al. | 399/329 |

FOREIGN PATENT DOCUMENTS

| | | | |
|---|---|---|---|
| JP | 07-005783 | A * | 1/1995 |
| JP | 9-251252 | | 9/1997 |
| JP | 10-198206 | A * | 7/1998 |
| JP | 2002-162853 | | 6/2002 |
| JP | 2003-005566 | | 1/2003 |
| JP | 2004-109583 | | 4/2004 |
| JP | 2007-65092 | | 3/2007 |

* cited by examiner

*Primary Examiner*—Sophia S Chen
(74) *Attorney, Agent, or Firm*—Morgan, Lewis & Bockius LLP

(57) ABSTRACT

The fixing device is provided with: a fixing roll that is rotatable; a belt member that is stretched by the fixing roll; a pressure roll that presses the fixing roll through the belt member; and a peeling member that presses an outer surface of the belt member against the pressure roll. The pressure roll presses the belt member with pressure at an edge portion of the belt member larger than pressure at a central portion of the belt member in an axial direction, and the peeling member presses the belt member with pressure at the edge portion of the belt member equal to or larger than pressure at the central portion of the belt member in the axial direction.

11 Claims, 9 Drawing Sheets

FIXING DEVICE, IMAGE FORMING APPARATUS AND FIXING METHOD

CROSS REFERENCE TO RELATED APPLICATIONS

This application is based on and claims priority under 35 USC §119 from Japanese Patent Application No. 2007-290206 filed Nov. 7, 2007.

BACKGROUND

1. Technical Field

The present invention relates to a fixing device used in an image forming apparatus with, for example, an electrophotographic method, and to an image forming apparatus and a fixing method. More specifically, the fixing device includes a belt member that is rotatable.

2. Related Art

An image forming apparatus such as an electrophotographic copier or a printer usually includes a fixing device which fuses and fixes a resin component of the toner transferred on a recording medium, by applying heat and pressure (nip pressure) simultaneously.

SUMMARY

According to an aspect of the invention, there is provided a fixing device including: a fixing roll that is rotatable; a belt member that is stretched by the fixing roll; a pressure roll that presses the fixing roll through the belt member; and a peeling member that presses an outer surface of the belt member against the pressure roll. The pressure roll presses the belt member with pressure at an edge portion of the belt member larger than pressure at a central portion of the belt member in an axial direction, and the peeling member presses the belt member with pressure at the edge portion of the belt member equal to or larger than pressure at the central portion of the belt member in the axial direction.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the attached drawings.

Figure 1:
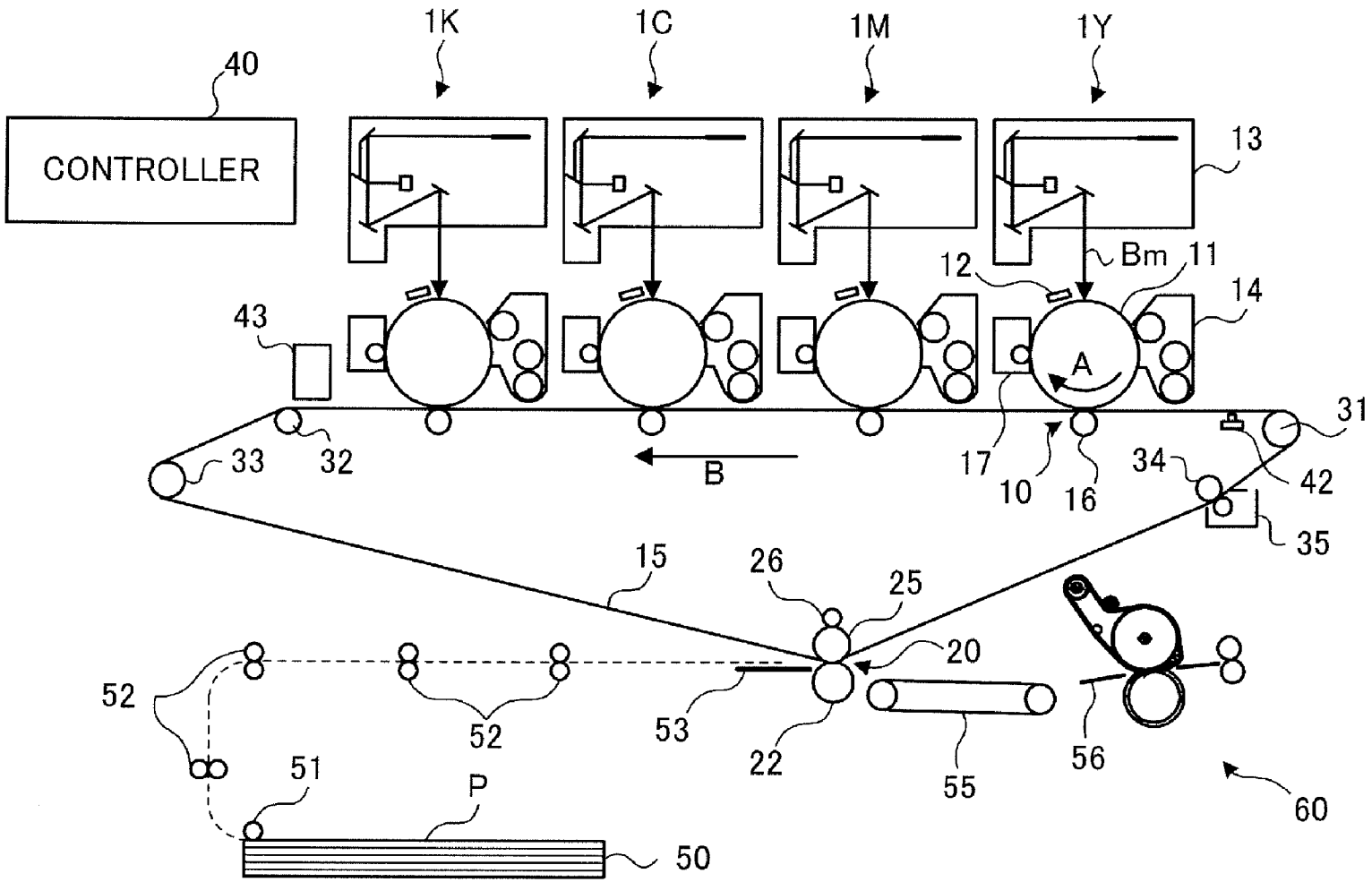
FIG. 1 is a schematic configuration diagram illustrating an image forming apparatus to which the exemplary embodiment is applied.

FIG. 1 is a schematic configuration diagram illustrating an image forming apparatus to which the exemplary embodiment is applied. The image forming apparatus shown in FIG. 1 is an image forming apparatus with an intermediate transfer method, which is generally called as a tandem type. The image forming apparatus is provided with plural image forming units 1Y, 1M, 1C and 1K in which respective color component toner images are formed with an electrophotographic method, a primary transfer unit 10 that sequentially transfers (primarily transfers) the respective color component toner images formed in the image forming units 1Y, 1M, 1C and 1K onto an intermediate transfer belt 15, a secondary transfer unit 20 that collectively transfers (secondarily transfers) superimposed toner images that have been transferred onto the intermediate transfer belt 15, onto a paper sheet P that is a recording medium (recording paper) and a fixing device 60 that fixes the secondarily-transferred images on the paper sheet P. In addition, the image forming apparatus is provided with a controller 40 that controls operation of the respective devices (respective units).

In the present exemplary embodiment, around a photoconductor drum 11 of each of the image forming units 1Y, 1M, 1C and 1K, which rotates in an arrow A direction, electrophotographic devices such as a charging device 12 that charges the photoconductor drum 11, a laser exposure device 13 that writes an electrostatic latent image on the photoconductor drum 11 (an exposure beam thereof is denoted by Bm in the figure), a development device 14 that stores each color component toner and visualizes the electrostatic latent image on the photoconductor drum 11 with the toner, a primary transfer roll 16 that transfers each color component toner image formed on the photoconductor drum 11 onto the intermediate transfer belt 15 at the primary transfer unit 10, and a drum cleaner 17 that removes remaining toner on the photoconductor drum 11 are sequentially disposed. The image forming units 1Y, 1M, 1C and 1K are approximately linearly arranged from an upstream side of the intermediate transfer belt 15, in order of yellow (Y), magenta (M), cyan (C) and black (K).

The intermediate transfer belt 15 as an intermediate transfer body is configured by a film-shaped endless belt made of resin such as polyimide or polyamide, which contains an appropriate amount of an antistatic agent such as carbon black. The intermediate transfer belt 15 is formed so that the volume resistivity thereof is $10^6$ to $10^{14}$ Ωcm and the thickness thereof is, for example, around 0.1 mm. The intermediate transfer belt 15 is circularly driven (is rotated) at a predetermined speed in an arrow B direction shown in FIG. 1, by respective rolls. As the respective rolls, a driving roll 31 that is driven by a motor excellent in a constant-speed property (not shown in the figure) and rotates the intermediate transfer belt 15, a supporting roll 32 that supports the intermediate transfer belt 15 approximately linearly extending along an arranging direction of the photoconductor drums 11, a tension roll 33 that functions as a correction roll for restraining meandering of the intermediate transfer belt 15 while applying a constant tension force to the intermediate transfer belt 15, a back-up roll 25 that is disposed at the secondary transfer unit 20, and a cleaning back-up roll 34 that is disposed at a cleaning unit in which remaining toner on the intermediate transfer belt 15 is scraped off are disposed.

The primary transfer unit 10 is configured by the primary transfer roll 16 that is arranged so as to be opposed to the photoconductor drum 11 through the intermediate transfer belt 15. The primary transfer roll 16 is configured by a shaft, and a sponge layer as an elastic body layer fixedly attached around the shaft. The shaft is a cylindrical stick made of a metal such as iron or stainless steel (SUS). The sponge layer is a cylindrical spongy roll made of a rubber blend of NBR, SBR and EPDM containing a conductive material such as carbon black, with the volume resistivity of $10^7$ to $10^9$ Ωcm. The primary transfer roll 16 is arranged so as to be in contact with the photoconductor drum 11 with pressure through the intermediate transfer belt 15. Moreover, to the primary transfer roll 16, a voltage (a primary transfer bias) having a polarity opposite to the charging polarity of the toner (assumed as a minus polarity, similarly hereinafter) is applied. Thereby, the toner images on the respective photoconductor drums 11 are electrostatically attracted to the intermediate transfer belt 15 in sequence, and then, superimposed toner images are formed on the intermediate transfer belt 15.

The secondary transfer unit 20 is configured by a secondary transfer roll 22 that is arranged on the toner image holding face side of the intermediate transfer belt 15, and the back-up roll 25. The back-up roll 25 is configured by a surface that is a tube made of a rubber blend of EPDM and NBR in which carbon black is dispersed, and an inside made of EPDM rubber. The back-up roll 25 is formed so that the surface resistivity thereof is $10^7$ to $10^{10}$ Ω/sq., and the hardness thereof is set to 70 degrees (Asker C), for example. The back-up roll 25 is arranged on a back face side of the intermediate transfer belt 15, functions as an opposite electrode of the secondary transfer roll 22, and is in contact with a metallic power-feeding roll 26 to which a secondary transfer bias is stably applied.

The secondary transfer roll 22 is configured by a shaft, and a sponge layer as an elastic body layer fixedly attached around the shaft. The shaft is a cylindrical stick made of a metal such as iron or SUS. The sponge layer is a cylindrical spongy roll made of a rubber blend of NBR, SBR and EPDM containing a conductive material such as carbon black, with the volume resistivity of $10^7$ to $10^9$ Ωcm. The secondary transfer roll 22 is arranged so as to be in contact with the back-up roll 25 with pressure through the intermediate transfer belt 15. Moreover, since the secondary transfer roll 22 is grounded, the secondary transfer bias is formed between the secondary transfer roll 22 and the back-up roll 25, and the toner image is secondarily transferred onto the paper sheet P transported to the secondary transfer unit 20.

On the downstream side of the secondary transfer unit 20 of the intermediate transfer belt 15, an intermediate transfer belt cleaner 35 is provided so as to be freely moved toward and away from the intermediate transfer belt 15. The intermediate transfer belt cleaner 35 removes remaining toner and paper dust on the intermediate transfer belt 15 after the secondary transfer, and cleans the surface of the intermediate transfer belt 15. On the upstream side of the image forming unit 1Y for yellow, a reference sensor (a home position sensor) 42 that generates a reference signal as a reference for adjusting timing for image formation in the respective image forming units 1Y, 1M, 1C and 1K is disposed. Moreover, on the downstream side of the image forming unit 1K for black, an image density sensor 43 for adjusting image quality is disposed. The reference sensor 42 generates a reference signal by recognizing a predetermined mark put on a back side of the intermediate transfer belt 15. The respective image forming units 1Y, 1M, 1C and 1K are configured so as to start image formation in response to an instruction from the controller 40 based on the recognition of the reference signal.

The image forming apparatus of the present exemplary embodiment is provided with, as a paper-sheet transportation system, a paper sheet tray 50 that stores paper sheets P, a pick-up roll 51 that takes out the paper sheet P stacked on the paper sheet tray 50 at a predetermined timing and transports the paper sheet P, transporting rolls 52 that transport the paper sheet P taken out by the pick-up roll 51, a transporting shoot 53 that feeds the paper sheet P transported by the transporting roll 52, to the secondary transfer unit 20, a transporting belt 55 that transports the paper sheet P transported after the secondary transfer by the secondary transfer roll 22, to the fixing device 60, and a fixing entrance guide 56 that guides the paper sheet P into the fixing device 60.

Next, a description will be given for a basic image forming process of the image forming apparatus according to the present exemplary embodiment. In the image forming apparatus shown in FIG. 1, image data outputted from an image reading apparatus (IIT: image input terminal), a personal computer (PC) or the like, which is not shown in the figure, are subjected to a predetermined image processing by an image processing apparatus (IPS) that is not shown in the figure, and then, an image forming operation is executed by the image forming units 1Y, 1M, 1C and 1K. In the IPS, inputted reflectance data are subjected to a predetermined image processing such as shading correction, displacement correction, lightness and color space conversion, gamma correction, various kinds of image editing like a frame erase, color editing, move editing and the like. The image data that have been subjected to the image processing are converted to the color material tone data of four colors of Y, M, C and K. Then, the data are outputted to the laser exposure device 13.

The laser exposure device 13, with the exposure beam Bm outputted from, for example, a semiconductor laser, irradiates the respective photoconductor drums 11 of the image forming units 1Y, 1M, 1C and 1K in accordance with the inputted color material tone data. In each of the photoconductor drums 11 of the image forming units 1Y, 1M, 1C and 1K, the surface thereof is charged by the charging device 12, and scanned and exposed by the laser exposure device 13, and an electrostatic latent image is formed thereon. The formed electrostatic latent image is developed as a toner image of each of colors of Y, M, C and K, by the development device 14 in each of the image forming units 1Y, 1M, 1C and 1K.

The toner image formed on each of the photoconductor drums 11 of the image forming units 1Y, 1M, 1C and 1K is transferred onto the intermediate transfer belt 15 at the primary transfer unit 10 where each of the photoconductor drums 11 is in contact with the intermediate transfer belt 15. More specifically, at the primary transfer unit 10, to a base material of the intermediate transfer belt 15, voltage (a primary transfer bias) having a polarity (plus polarity) opposite to the charging polarity of the toner is applied by the primary transfer roll 16, and the primary transfer is carried out by superimposing the toner images on the surface of the intermediate transfer belt 15 in sequence.

After the toner images are primarily transferred to the surface of the intermediate transfer belt 15 in sequence, the toner images are transported to the secondary transfer unit 20 by movement of the intermediate transfer belt 15. When the toner images are transported to the secondary transfer unit 20, in the paper sheet transporting system, the pick-up roll 51 rotates in accordance with the timing when the toner images are transported to the secondary transfer unit 20, and the paper sheet P with a predetermined size is supplied from the paper sheet tray 50. The paper sheet P supplied by the pick-up roll 51 is transported by the transporting rolls 52 and reaches the secondary transfer unit 20 via the transporting shoot 53. Before reaching the secondary transporting unit 20, the paper sheet P is stopped once. Then, a resist roll (not shown in the figure) rotates in accordance with the moving timing of the intermediate transfer belt 15 on which the toner images are held, so that the position of the paper sheet P and the position of the toner images are aligned.

At the secondary transfer unit 20, the secondary transfer roll 22 is pressed against the back-up roll 25 through the intermediate transfer belt 15. The paper sheet P transported at a right timing is sandwiched between the intermediate transfer belt 15 and the secondary transfer roll 22. At this time, if the voltage (the secondary transfer bias) having the same polarity (minus polarity) as the charging polarity of the toner is applied by the metallic power-feeding roll 26, a transfer electric field is formed between the secondary transfer roll 22 and the back-up roll 25. Then, the unfixed toner images held on the intermediate transfer belt 15 are collectively and electrostatically transferred onto the paper sheet P at the secondary transfer unit 20 where the secondary transfer roll 22 and the back-up roll 25 are pressed against each other.

Thereafter, the paper sheet P on which the toner images are electrostatically transferred is transported by the secondary transfer roll 22 in the state where the paper sheet P is removed from the intermediate transfer belt 15, and further transported to the transporting belt 55 provided on the downstream side of the secondary transfer roll 22 in the paper-sheet transporting direction. On the transporting belt 55, the paper sheet P is transported to the fixing device 60 at an optimal transporting speed in accordance with a transporting speed in the fixing device 60. The unfixed toner images on the paper sheet P transported to the fixing device 60 are fixed on the paper sheet P by a fixing processing with heat and pressure in the fixing device 60. The paper sheet P on which the fixed image is formed is transported to the discharged paper-sheet stacking unit (not shown in the figure) provided in the exit unit of the image forming apparatus. On the other hand, after the transfer onto the paper sheet P is completed, remaining toner on the intermediate transfer belt 15 is transported according to the rotational movement of the intermediate transfer belt 15, and is removed from the intermediate transfer belt 15 by the cleaning back-up roll 34 and the intermediate transfer belt cleaner 35.

Next, a description will be given for the fixing device 60 used in the image forming apparatus of the present exemplary embodiment.

Figure 2:
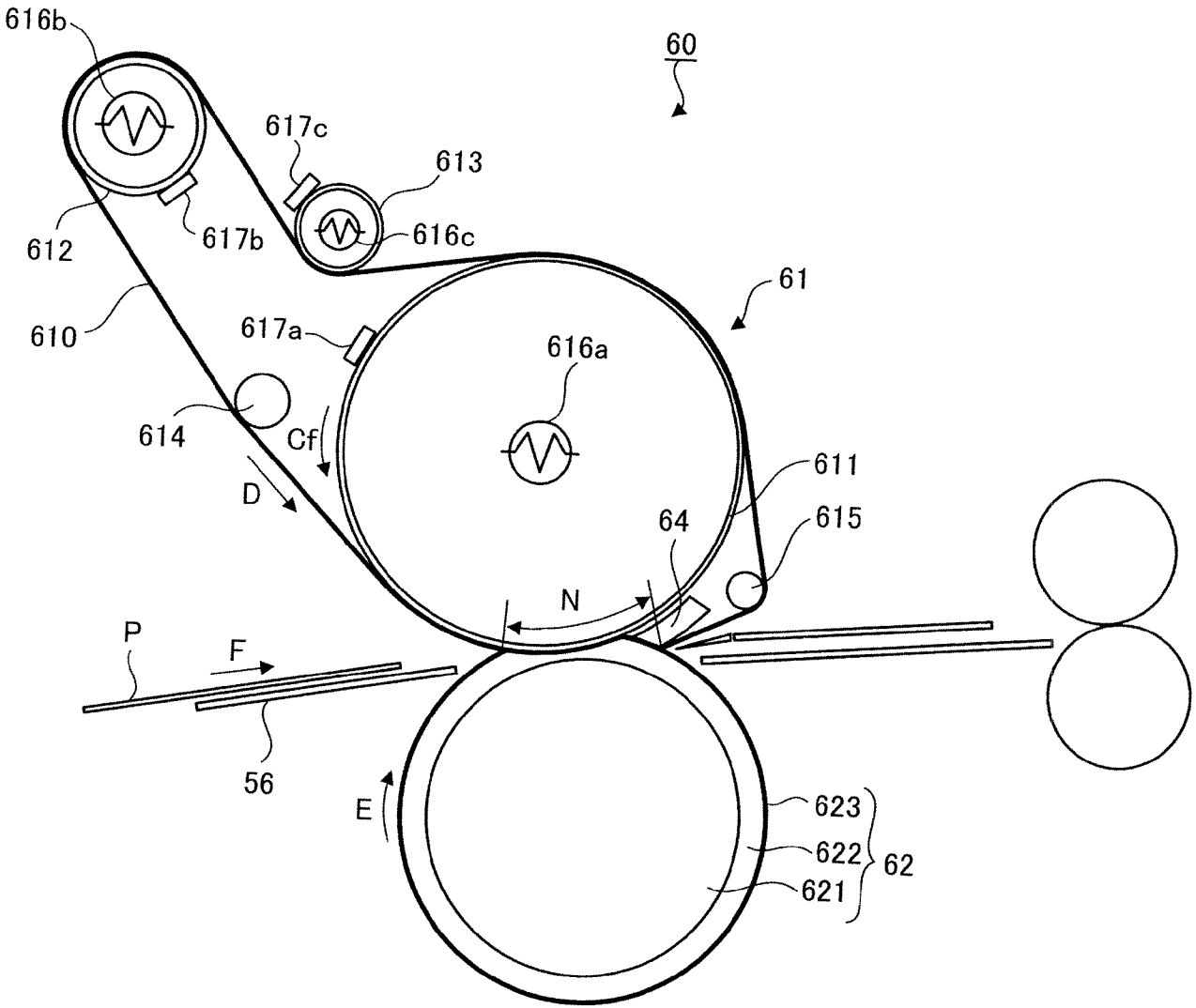
FIG. 2 is a sectional side view illustrating a schematic configuration of the fixing device of the exemplary embodiment.

FIG. 2 is a sectional side view illustrating a schematic configuration of the fixing device 60 of the exemplary embodiment. The main part of the fixing device 60 is configured by a fixing belt module 61, and a pressure roll 62 that is arranged so as to be in contact with the fixing belt module 61 with pressure.

The main part of the fixing belt module 61 is configured by a fixing belt 610 as an example of a belt member rotating in an arrow D direction, a fixing roll 611 that rotationally drives the fixing belt 610 while stretching the fixing belt 610, a stretcher roll 612 that stretches the fixing belt 610 from the inner side, a stretcher roll 613 that stretches the fixing belt 610 from the outer side, an attitude correction roll 614 that corrects an attitude of the fixing belt 610 between the fixing roll 611 and the stretcher roll 612, a peeling pad 64 as an example of a peeling member that is arranged near the fixing roll 611 and on a downstream region within a nip portion N where the fixing belt module 61 and the pressure roll 62 are in contact with each other with pressure, a stretcher roll 615 that stretches the fixing belt 610 on the downstream side of the nip portion N.

The fixing belt 610 is a flexible endless belt with a circumferential length of 168 mm and a width of 340 mm, for example. The fixing belt 610 is formed of, for example, a base layer made of polyimide resin with a thickness of 90 μm, an elastic body layer made of silicone rubber with a thickness of 160 μm and stacked on the surface side (outer circumferential side) of the base layer, and a release layer formed of tetrafluoroethylene-perfluoroalkylvinylether copolymer resin (PFA) tube with a thickness of 30 μm covering the elastic body layer. Here, the elastic body layer is provided in order to increase image quality especially in color images. It should be noted that, in a configuration of the fixing belt 610, a material, a thickness, hardness thereof and the like may be appropriately chosen in accordance with condition of the apparatus design, such as a purpose of use and a usage condition.

The fixing roll 611 is a cylindrical roll made of aluminum with an outer diameter of 100 mm, a length of 360 mm and a thickness of 10 mm, for example. The fixing roll 611 receives driving force from a driving motor (not shown in the figure) and rotates in an arrow Cf direction at a surface speed of 264 mm/s, for example.

A halogen heater 616*a* as a heater is disposed inside the fixing roll 611. The surface temperature of the fixing roll 611 is controlled so as to be a predetermined value, by the controller 40 of the image forming apparatus (refer to FIG. 1), based on the measured value of a temperature sensor 617*a* arranged so as to be in contact with the surface of the fixing roll 611.

The stretcher roll 612 is a cylindrical roll made of aluminum with an outer diameter of 30 mm, a radial thickness of 2 mm and a length of 360 mm, for example. A halogen heater 616*b* as a heater is disposed inside the stretcher roll 612, and the surface temperature thereof is controlled so as to be about 190 degrees, by a temperature sensor 617*b* and the controller 40 (refer to FIG. 1). Accordingly, the stretcher roll 612 has not only a function of stretching the fixing belt 610 but also a function of heating the fixing belt 610 from the inner circumferential side.

At the both edge portions of the stretcher roll 612, spring members (not shown in the figure) that press the fixing belt 610 outward are disposed, whereby tension force of the entire fixing belt 610 is kept a predetermined value. At the time, this allows the tension force applied throughout the fixing belt 610 to be uniform in the axial direction.

The stretcher roll 613 is a cylindrical roll made of aluminum with an outer diameter of 25 mm, a radial thickness of 2 mm and a length of 360 mm, for example. On the surface of the stretcher roll 613, a release layer made of PFA with a thickness of 20 μm is formed, for example. The release layer is formed so as to prevent a small amount of offset toner or paper dust coming from the outer circumferential surface of the fixing belt 610, from piling on the stretcher roll 613.

A halogen heater 616*c* as a heater is disposed inside the stretcher roll 613. The surface temperature is controlled by a temperature sensor 617*c* and the controller 40 (refer to FIG. 1) so as to become a predetermined temperature. Accordingly, the stretcher roll 613 has not only a function for stretching the fixing belt 610 but also a function for heating the fixing belt 610 from the outer circumferential surface side. Thus, in the present exemplary embodiment, the configuration in which the fixing belt 610 is heated by the fixing roll 611, the stretcher roll 612 and the stretcher roll 613 is adopted.

The attitude correction roll 614 is a cylindrical roll made of aluminum with an outer diameter of 15 mm and a length of 360 mm, for example. Near the attitude correction roll 614, a belt-edge position detecting mechanism (not shown in the figure) that detects edge positions of the fixing belt 610 is arranged. In the attitude correction roll 614, an axial displacement mechanism that changes a contact position of the fixing belt 610 in an axial direction in accordance with a detection result of the belt-edge position detecting mechanism is disposed. Therefore, the attitude correction roll 614 controls meandering (belt walk) of the fixing belt 610.

The stretcher roll 615 is a cylindrical roll made of aluminum with an outer diameter of 12 mm and a length of 360 mm. The stretcher roll 615 is arranged near the downstream side of the peeling pad 64 in a movement direction of the fixing belt 610 so that the fixing belt 610 after passing through the peeling pad 64 is smoothly rotated towards the fixing roll 611.

The peeling pad 64 is a block member formed of a rigid body of a metal such as SUS or aluminum, a resin or the like, for example. The cross section thereof is an arc-like shape. The peeling pad 64 is fixedly arranged over an entire region of the fixing roll 611 in the axial direction near the downstream side of a region ("a roll nip portion N1": refer to FIG. 3 described later) where the pressure roll 62 is in contact with the fixing roll 611 through the fixing belt 610 with pressure. Further, the peeling pad 64 is arranged so as to uniformly press a predetermined width region of the pressure roll 62 (for example, a width of 8.5 mm along the movement direction of the fixing belt 610) with a predetermined load (for example, about 390N (about 40 kgf) through the fixing belt 610, and forms "a peeling pad nip portion N2" described later (refer to FIG. 3 described later).

Furthermore, the peeling pad 64 may be provided with a sliding sheet (a sliding layer) as a sliding layer that covers a periphery. As the sliding sheet, a fluoroethylene resin-impregnated glass fiber sheet may be used, for example. By providing the sliding sheet, the peeling pad 64 smoothly slides on the inner surface of the fixing belt 610 and the surface of the fixing roll 611.

Next, the pressure roll 62 is formed of a cylindrical roll 621 made of, for example, aluminum with a diameter of 65 mm and a length of 360 mm as a base substance, an elastic layer 622 made of silicone rubber with rubber hardness of 30 degrees (JIS-A) and a thickness of 10 mm, and a release layer 623 formed of a PFA tube with a film thickness of 100 μm. The elastic layer 622 and the release layer 623 are sequentially stacked on the base substance. The pressure roll 62 is provided so as to be pressed against the fixing belt module 61, and is driven by the fixing roll 611 according to the rotation of the fixing roll 611 in the fixing belt module 61 in the arrow Cf direction. Thus, the pressure roll 62 is rotated in an arrow E direction. The moving speed is 264 mm/s that is the same as the surface speed of the fixing roll 611.

Next, a description will be given of the nip portion N in which the fixing belt module 61 and the pressure roll 62 are pressed against each other.

Figure 3:
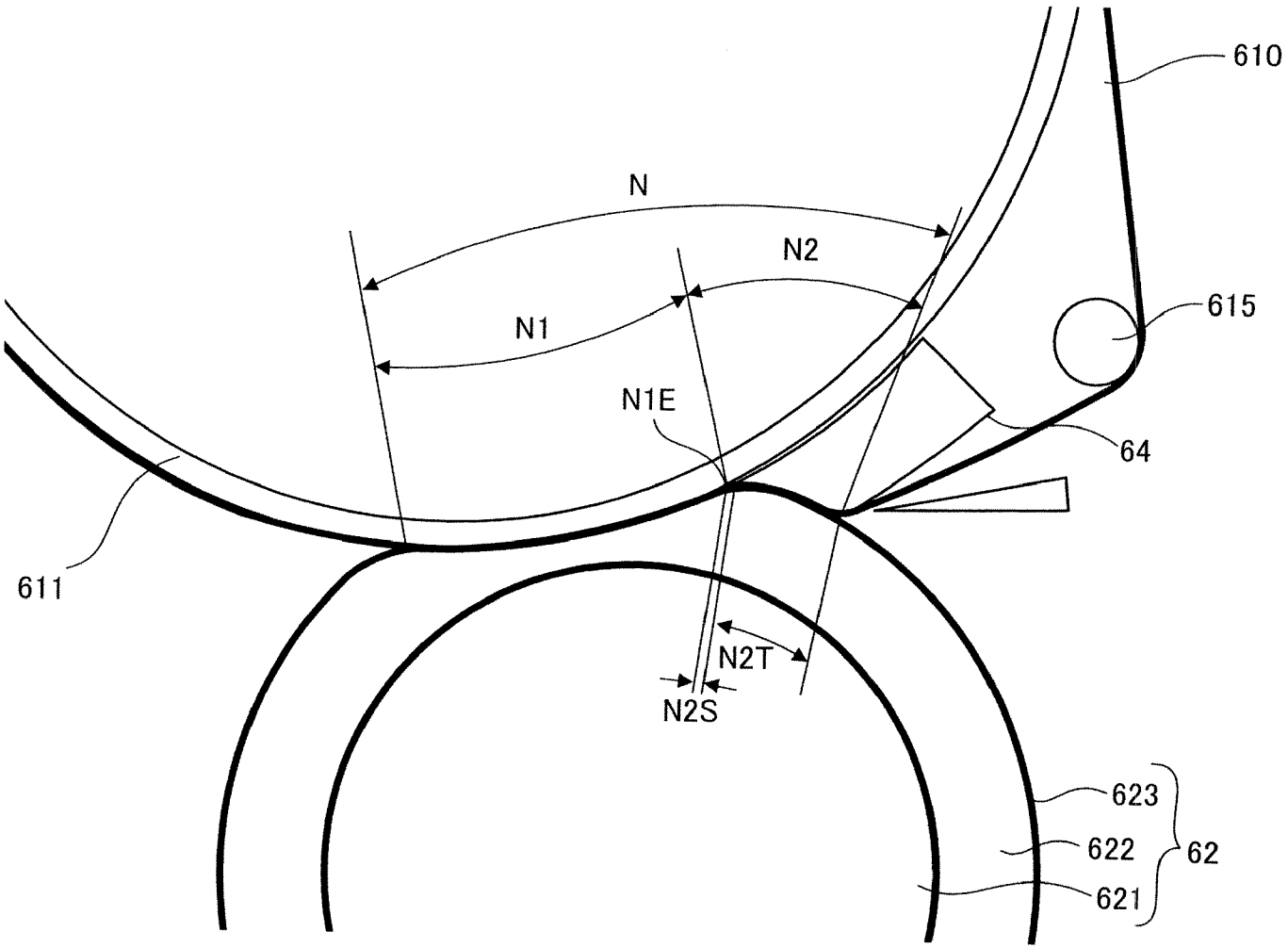
FIG. 3 is a schematic cross-sectional view showing a vicinity region of the nip portion.

FIG. 3 is a schematic cross-sectional view showing a vicinity region of the nip portion N. As shown in FIG. 3, the nip portion N, in which the fixing belt module 61 (see FIG. 2) and the pressure roll 62 are pressed against each other, includes the roll nip portion (first nip portion) N1 formed by disposing the pressure roll 62 so as to press against an outer circumferential surface of the fixing belt 610 in an area (wrap area) in which the fixing belt 610 is wound (wrapped) around the fixing roll 611.

As described above, in the fixing device 60 of the present exemplary embodiment, the fixing roll 611, which is one of the rolls forming the roll nip portion N1, is a hard roll formed of a cored bar (core roll) made of aluminum, and heat-resistant resin (fluororesin) covering a surface of the cored bar, and is not covered with any elastic layer. The pressure roll 62, which is the other roll forming the roll nip portion N1, is a soft roll formed of a cored bar (core roll) made of aluminum, and the elastic layer 622 covering a surface of the cored bar.

With the above-described configuration of the fixing roll 611 and the pressure roll 62, the elastic layer 622 of the pressure roll 62 is deformed, whereby the roll nip portion N1 of the present exemplary embodiment is formed. Here, the pressure roll 62 functions as a roll (NFPR: nip forming pressure roll) that forms a nip (the roll nip portion N1). Specifically, a state in which only the surface of the pressure roll 62 is dented to a large extent while the fixing roll 611 is hardly dented (a dent amount of the pressure roll 62>a dent amount of the fixing roll 611) is formed in the roll nip portion N1. Thereby, a nip region having a predetermined width in the movement direction of the fixing belt 610 is formed.

As described above, in the fixing device 60 of the present exemplary embodiment, the fixing roll 611, around which the fixing belt 610 is wrapped, is hardly deformed in the roll nip portion N1 and maintains a cylinder shape. Accordingly, the fixing belt 610 rotates along the circumferential surface of the fixing roll 611, and, hence, no change occurs in the rotation radius. Consequently, the fixing belt 610 passes the roll nip portion N1 while keeping the movement speed constant. With this configuration, the fixing belt 610 is less likely to be wrinkled or distorted even when passing the roll nip portion N1. As a result, distortion in a fixed image is prevented, whereby a high-quality fixed image is stably provided. Here, in the fixing device 60 of the present exemplary embodiment, the roll nip portion N1 is set to be 15 mm in width along the movement direction of the fixing belt 610.

Near the downstream side of the roll nip portion N1, the peeling pad 64 is disposed. The peeling pad 64 presses the fixing belt 610 against a surface of the pressure roll 62. Thereby, the peeling pad nip portion (second nip portion) N2 in which the fixing belt 610 is wrapped around the surface of the pressure roll 62 is formed on the downstream side of the roll nip portion N1 so as to be continuous with the roll nip portion N1.

As shown in FIG. 3, the peeling pad 64, by which the peeling pad nip portion N2 is formed, is formed to have a cross section in an approximately circular arc shape, and is arranged along the axial direction of the fixing roll 611, near the downstream side of the roll nip portion N1. The fixing belt 610 rotates by following an outer face of the peeling pad 64, after passing the peeling pad nip portion N2. Thereby, the movement direction of the fixing belt 610 drastically changes so as to be bent in the direction toward the tension roll 615 by the peeling pad 64. As a result, the paper sheet P having passed the roll nip portion N1 and the peeling pad nip portion N2 does not follow the change in the movement direction of the fixing belt 610 when leaving the peeling pad nip portion N2, and is hence peeled from the fixing belt 610 due to its so-called "stiffness." The separation from the curvature of the fixing belt 610 is stably performed on the paper sheet P at an exit portion of the peeling pad nip portion N2. Here, in the fixing device 60 of the present exemplary embodiment, the peeling pad nip portion N2 is set to be 8.5 mm in width along the movement direction of the fixing belt 610.

In such a peeling mechanism using the above-described separation from the curvature of the fixing belt 610 caused by disposing the peeling pad 64, since the peeling pad nip portion N2 is formed to be continuous with the roll nip portion N1, in a boundary region N2S located closer to the roll nip portion N1 than a region N2T, no member directly presses the fixing belt 610 against either the fixing roll 611 or the pressure roll 62. The region N2T is where the peeling pad 64 is disposed in the peeling pad nip portion N2 (a portion in which the peeling pad 64 and the pressure roll 62 are pressed against each other). Accordingly, the fixing belt 610 is pressed against the pressure roll 62 only by its own tensile force in the boundary region N2S. Thus, the nip pressure in the boundary region N2S (hereinafter, the nip pressure in the boundary region N2S is denoted by Pn) is formed only by the tensile force of the fixing belt 610. For this reason, when the peeling pad 64 is disposed with a distance larger than a predetermined distance from a downstream-side end portion N1E of the roll nip portion N1, the boundary region N2S is located between the roll nip portion N1 and the region N2T in which the peeling pad 64 is disposed, and the nip pressure Pn of the boundary region N2S is below a predetermined value (to be denoted by Pn1). Thereby, the boundary region N2S is formed as a valley region with a fall of the nip pressure. Consequently, the nip pressure Pn of the boundary region N2S is low compared to the nip pressures of the roll nip portion N1 and the region N2T in which the peeling pad 64 is disposed.

Figure 4:
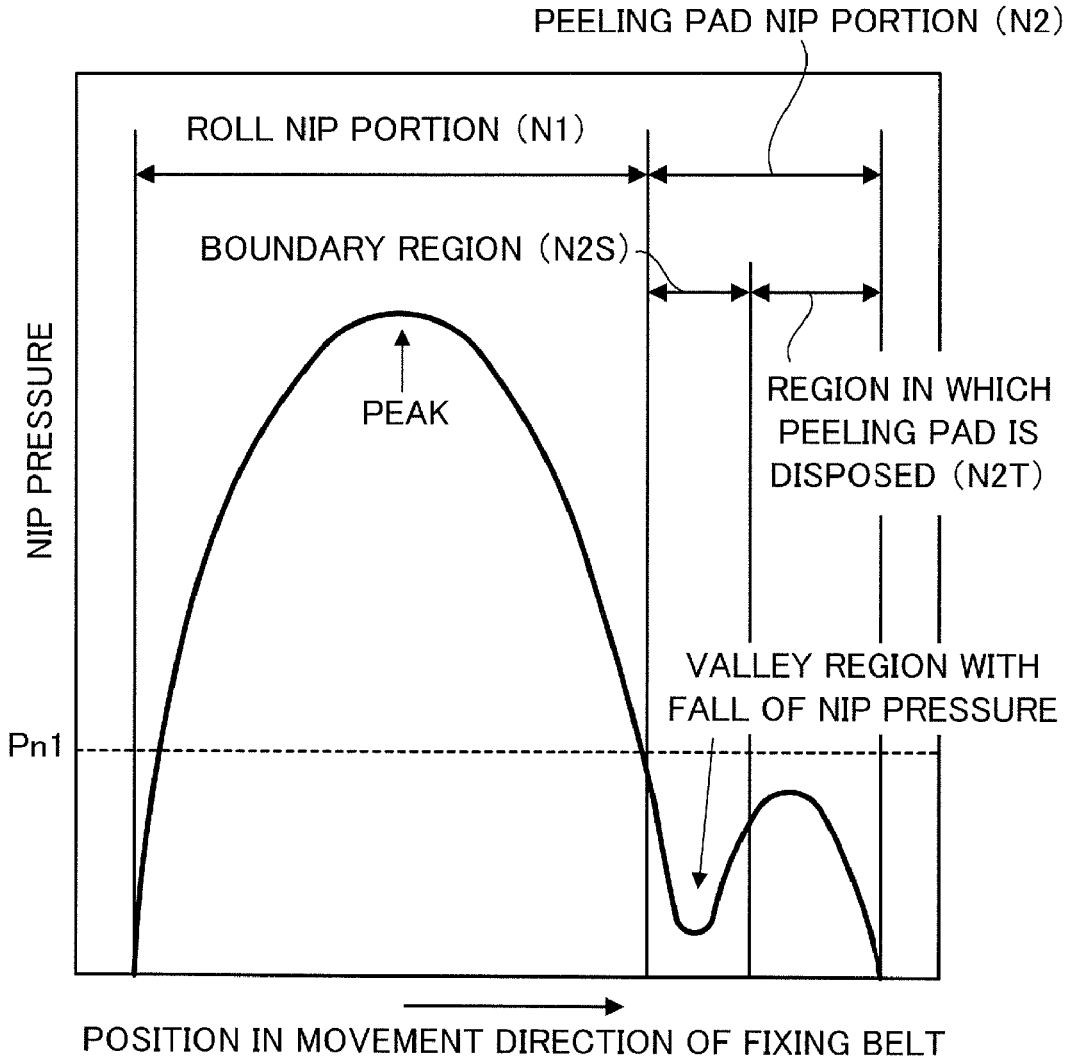
FIG. 4 is a graph schematically showing the pressure distribution in a nip portion (including the roll nip portion and the peeling pad nip portion) in a case where the peeling pad is disposed with a space having a predetermined distance or longer from the downstream-side end portion of the roll nip portion.

FIG. 4 is a graph schematically showing the pressure distribution in the nip portion N (including the roll nip portion N1 and the peeling pad nip portion N2) in a case where the peeling pad 64 is disposed with a distance having a predetermined distance or longer from the downstream-side end portion N1E of the roll nip portion N1. In this case, as shown in FIG. 4, the valley region in which the nip pressure Pn is below the predetermined value Pn1 is formed in the boundary region N2S of the peeling pad nip portion N2 between the roll nip portion N1 and the region N2T.

In a fixing process performed by the fixing device 60 of the present exemplary embodiment, heat and pressure are applied to the paper sheet P with a toner image transferred thereon, in the roll nip portion N1, and the toner is thereby fused and pressed to the paper sheet P. In this event, in the paper sheet P and the toner to which the heat has applied in the roll nip portion N1, water vapor is generated by evaporating the water contained in the paper sheet P, and the air contained in the toner thermally expands. However, no air gaps (air bubbles) due to the water vapor or expanded air are generated between the fixing belt 610 and the pressure roll 62 since high nip pressure is applied in the roll nip portion N1.

However, when the nip pressure Pn in the boundary region N2S, next to the roll nip portion N1, in the peeling pad nip portion N2, is lower than the predetermined value Pn1, the air bubbles that are restrained in the roll nip portion N1 become unrestrainable, and are consequently generated, in the boundary region N2S. When the paper sheet P comes into the region N2T having a high nip pressure, in which the peeling pad 64 is disposed, in the state that air bubbles are generated, the air bubbles generated in the boundary region N2S move around on a surface of the paper sheet P due to the high nip pressure. In such a case, since the toner image on the paper sheet P has just passed the roll nip portion N1 and is in a state in which the fused toner is not completely fixed, a phenomenon in which the toner image is distorted due to the air bubbles moving around occurs. As a result, defects such as blur occur in the fixed image.

Figure 5:
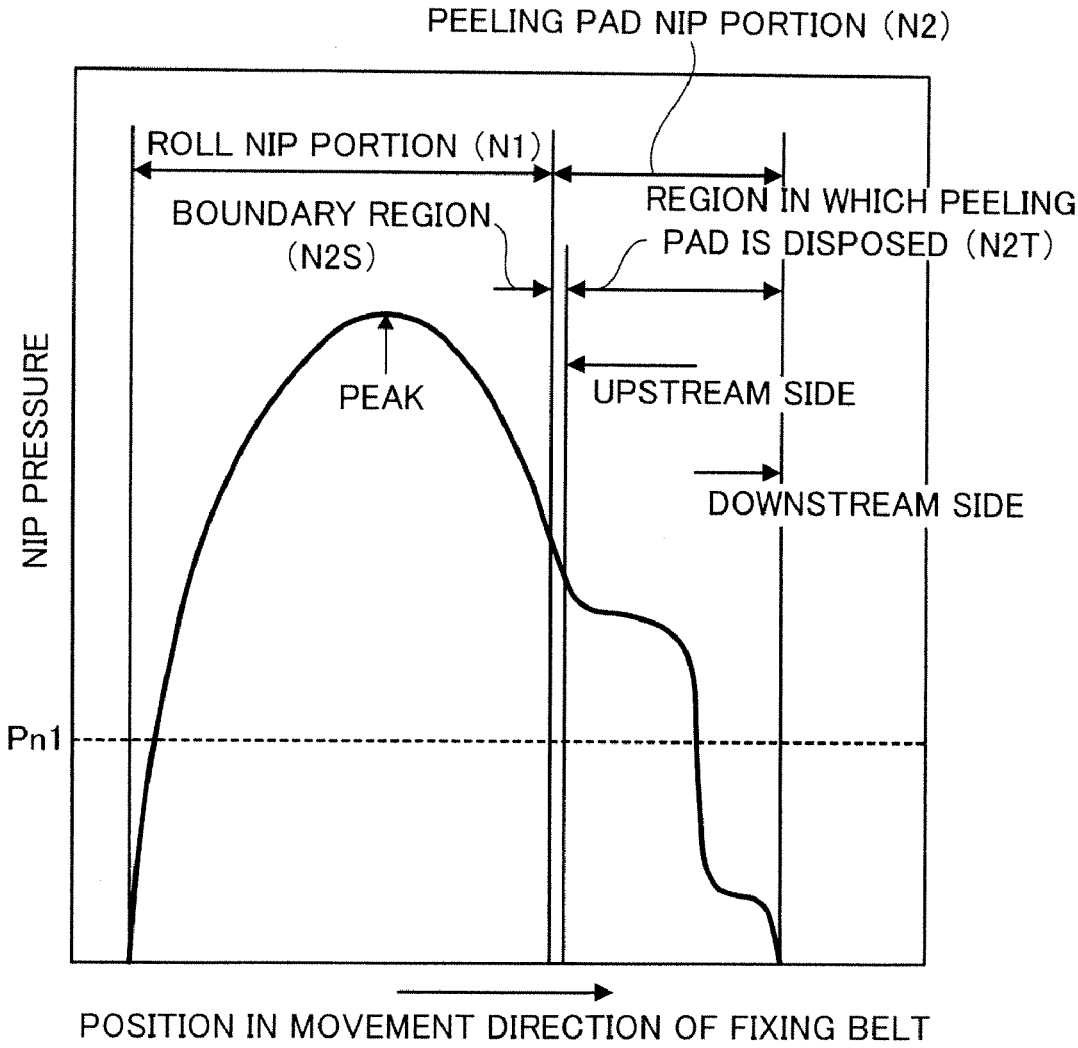
FIG. 5 is a graph schematically showing a pressure distribution in a case where the peeling pad is disposed near the downstream side of the roll nip portion.

In light of the above, in the fixing device 60 of the present exemplary embodiment, the peeling pad 64 is disposed near the downstream side of the roll nip portion N1. By disposing the peeling pad 64 in this manner, the width of the boundary region N2S, in the peeling pad nip portion N2, between the roll nip portion N1 and the region N2T in which the peeling pad 64 is disposed, maybe set as small as possible. Thereby, the region in which the fixing belt 610 is pressed against the pressure roll only by its tensile force is narrowed. Consequently, as shown in FIG. 5 (which is a graph schematically showing a pressure distribution in a case where the peeling pad 64 is disposed near the downstream side of the roll nip portion N1), in the boundary region N2S, occurrence of the valley region, in which the nip pressure Pn becomes lower than the predetermined value Pn1, may be prevented. Moreover, the nip pressure may be set so as to monotonously and continuously decrease the nip pressure in the region from the position at which the nip pressure reaches a peak in the roll nip portion N1 to the position of the end portion of the downstream of the peeling pad nip portion N2 in the nip portion N.

Since the nip pressure Pn of the boundary region N2S may be set to be higher than the predetermined Pn1, occurrence of air bubbles in the boundary region N2S may be prevented. Moreover, the nip pressure is set so as to monotonously and continuously decrease the nip pressure in the region from the position at which the nip pressure reaches a peak in the roll nip portion N1 to the position of the end portion of the downstream of the peeling pad nip portion N2 in the nip portion N. Accordingly, the water vapor and the thermally expanded air, which are suppressed by the high nip pressure in the roll nip portion N1, are gradually released in a course of passing the peeling pad nip portion N2. Thereby, the above-described phenomenon in which air bubbles move around may be prevented. As a result, the toner image in a state of not being completely fixed is hardly distorted, and defects such as blur in the fixed image may be prevented.

Figure 6:
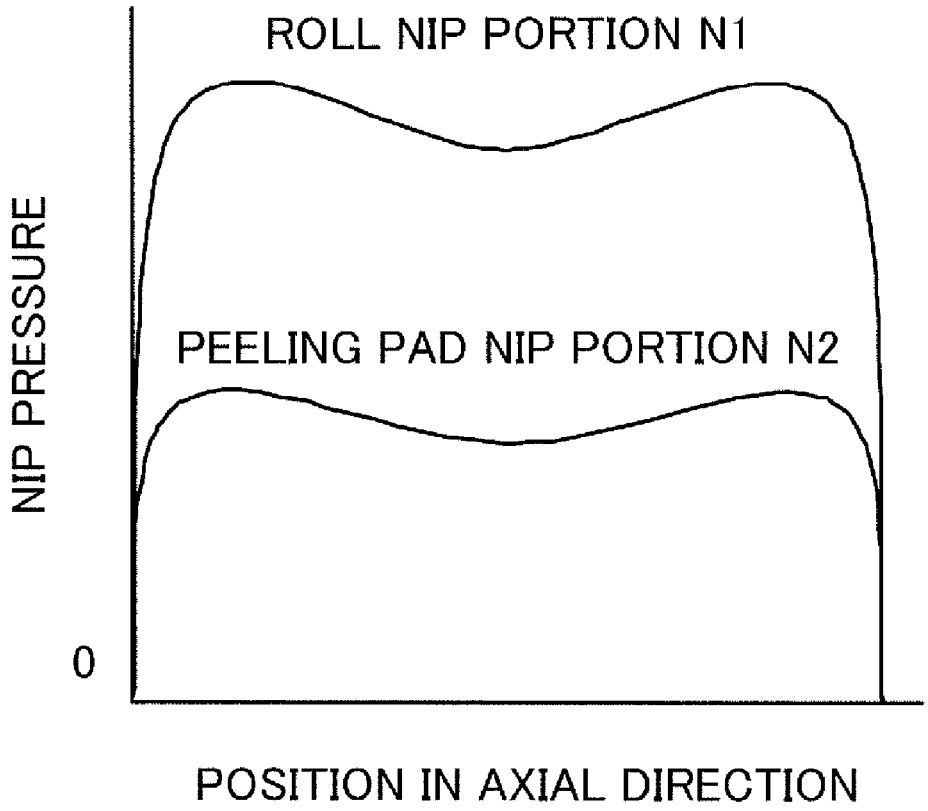
FIG. 6 is a graph schematically showing the pressure distributions of the nip pressures in the roll nip portion and the peeling pad nip portion, in the axial direction of the fixing belt.

FIG. 6 is a graph schematically showing the pressure distributions of the nip pressures in the roll nip portion N1 and the peeling pad nip portion N2, in the axial direction of the fixing belt 610.

In FIG. 6, the horizontal axis shows positions in the fixing belt 610 (refer to FIG. 3) in the axial direction, and the portions at which the nip pressure is 0 correspond to the edge portions of the fixing belt 610. In addition, the vertical axis in the FIG. 6 shows nip pressures in the roll nip portion N1 and the peeling pad nip portion N2.

As shown in FIG. 6, in the present exemplary embodiment, the pressure distribution of the nip pressure in the roll nip portion N1 is set so that the nip pressure may increase from the central portion of the fixing belt 610 to each of the edge portions thereof in the axial direction while drastically decreasing to 0 in the edge portions.

This pressure distribution may cause a speed distribution of the paper sheet P in the axial direction of the fixing belt 610, in the roll nip portion N1. Specifically, the paper sheet P is transported at a high speed in the edge portions of the fixing belt 610 while being transported at a low speed in the central portion compared to the edge portions. This difference in speed causes the paper sheet P to be smoothed out by the force that pulls the paper sheet P in the axial direction of the fixing belt 610. Hence, occurrence of wrinkles may be prevented.

In addition, in the present exemplary embodiment, the peeling pad nip portion N2 is also formed, and the pressure distribution in the peeling pad nip portion N2 also needs to be set properly besides the pressure distribution in the roll nip portion N1.

As shown in FIG. 6, the pressure distribution of the nip pressure in the peeling pad nip portion N2 is set so that the nip pressure may increase from the central portion of the fixing belt 610 to each of the edge portions thereof in the axial direction while drastically decreasing to 0 in the edge portions, in a similar manner to that in the roll nip portion N1. With this pressure distribution in the peeling pad nip portion N2, the paper sheet P may be transported without negating the speed distribution in the roll nip portion N1. Accordingly, occurrence of wrinkles may be prevented. It should be noted that the peeling pad nip portion N2 does not always need to have such a pressure distribution that the nip pressure increases from the central portion to each of the edge portions in the axial direction. The peeling pad nip portion N2 may have any pressure distribution but one negating the speed distribution in the roll nip portion N1. For example, the peeling pad nip portion N2 may have a pressure distribution in which the nip pressure is uniform from the central portion to each of the edge portions in the axial direction.

To obtain a pressure distribution as the one described above in the roll nip portion N1, the outer diameter of at least one of the fixing roll 611 and the pressure roll 62 (refer to FIG. 3) is set to be flared (i.e. the radius at the central portion<the radius at each of the edge portions), for example. The pressure distribution in the peeling pad nip portion N2 is obtained by setting the pressing face of the peeling pad 64 at the time of image formation (at the time of pressing) to have a curve shape in the axial direction so that the central portion is away from the pressing face compared to the edge portions, that is, a shape having a concave from the central portion to the edge portions in the axial direction.

Figure 7A:
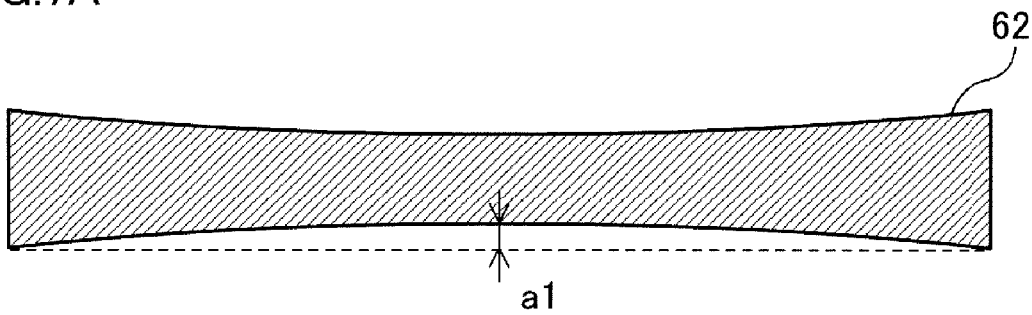
FIGS. 7A and 7B are views showing examples of the shapes of the pressure roll and the peeling pad, respectively.
Figure 7B:
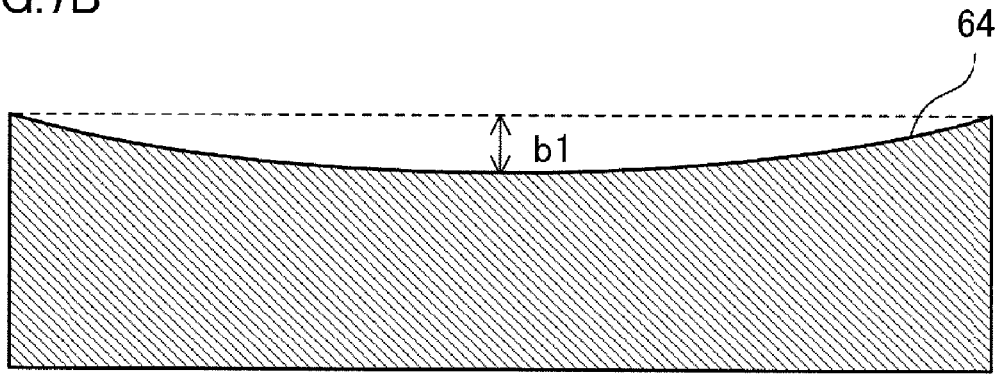

FIGS. 7A and 7B are views showing examples of the shapes of the pressure roll 62 and the peeling pad 64, respectively, in the above-described case.

Both FIGS. 7A and 7B are views seen from the pressing face, and a characteristic portion is emphasized in each of FIGS. 7A and 7B for descriptive purposes. FIG. 7A shows a case of setting the outer diameter of the pressure roll 62 to be flared, and the radius of each of the edge portions is set to be larger than that of the central portion by a1. FIG. 7B shows a case of setting the peeling pad 64 to have a concave shape from the central portion to the edge portions in the axial direction, and the central portion is set to be curved, compared to each of the edge portions, by b1. The length of a1 may be 200 μm, and the length of b1 may be 300 μm, for example.

It should be noted that a way to obtain pressure distributions as the ones described above is not limited to a method for changing the shape of the pressure roll 62 or the like. For example, a method of covering the pressure roll 62 with an elastic body and thereby setting the elastic modulus of the elastic body to be larger in the edge portions than in the central portion in the axial direction of the pressure roll 62 may be employed. Specifically, a method of covering the pressure roll 62 with silicone rubber or the like and setting the rubber hardness thereof to be larger in the edge portions than in the central portion in the axial direction of the pressure roll 62 may be employed.

In the present exemplary embodiment, when the flare amount of the external diameter of the fixing roll 611 is too large, a gap between the roll nip portion N1 and the peeling pad nip portion N2 in the central portion in the axial direction of the fixing belt 610 results in being large. In such a case, image defects such as blister are likely to occur. For this reason, the outer shape of the fixing roll 611 in the axial direction is preferably a straight shape (i.e. the radius from the central portion to the edge portions in the axial direction are approximately uniform), and the outer shape of the pressure roll 62 is preferably a flared shape (i.e. the radius at each of the edge portions is larger than that of the central portion in the axial direction). Similarly, when a surface of the fixing roll 611 is covered with an elastic body, image defects are likely to occur because the gap changes due to time deterioration of the elastic body. Accordingly, the fixing roll 611 is preferably a hard roll having no elastic layer, and the pressure roll 62 is preferably a soft roll covered with an elastic layer.

EXAMPLE

An experiment to see whether or not paper wrinkles occur was performed by using the following device under the following conditions.

[Fixing Device]

As the fixing device, the one shown in FIG. 2 is used.

As the fixing belt 610, one with a circumferential length of 168 mm is used. This fixing belt 610 is formed of: a base layer that is made of polyimide resin with a thickness of 90 μm; an elastic body layer that is made of silicone rubber with a thickness of 300 μm, and that is stacked on the base layer; and a release layer that is formed of tetrafluoroethylene-perfluoroalkylvinylether copolymer resin (PFA) tube with a thickness of 30 μm, and that covers the stacked layers.

As the fixing roll 611, one formed of a cylindrical roll, made of aluminum, with an outer diameter of 100 mm, and a PFA tube with a thickness of 300 μm that covers the cylindrical roll, is used. The surface of the fixing roll 611 is a straight shape.

As the pressure roll 62, one including the cylindrical roll 621 as the base, and the elastic layer 622 and the release layer 623, stacked on the base in this order, is used. The cylindrical roll 621 is made of aluminum with a diameter of 65 mm, and the elastic layer 622 is made of silicone rubber with a thickness of 10 mm, and the release layer 623 is formed of a PFA tube with a film thickness of 100 μm.

As the peeling pad 64, one formed of an SUS metal that is covered with fluororesin adhesive tape AGF-100A produced by Chukoh Chemical Industries, Ltd. as a slide sheet, is used.

The processing speed of fixing is set at 264 mm/s, and the temperature of the fixing belt 610 is set at 150 degrees C. The maximum value of the nip pressure in the roll nip portion N1 is set to be 1470N (150 kgf), while the maximum value of the nip pressure in the peeling pad nip portion N2 is set to be 390N (40 kgf).

[Paper Used for Experiment]

Relatively thin paper sheet are used for the experiment so as to allow wrinkles to positively occur. Specifically, OK Topkote N paper (with a basis weight of 84.9 gsm ($g/m^2$)) which is coated paper, and ST paper (with a basis weight of 52 gsm ($g/m^2$)), which is plain paper, produced by Oji paper Co., Ltd. are used.

Figure 8B:
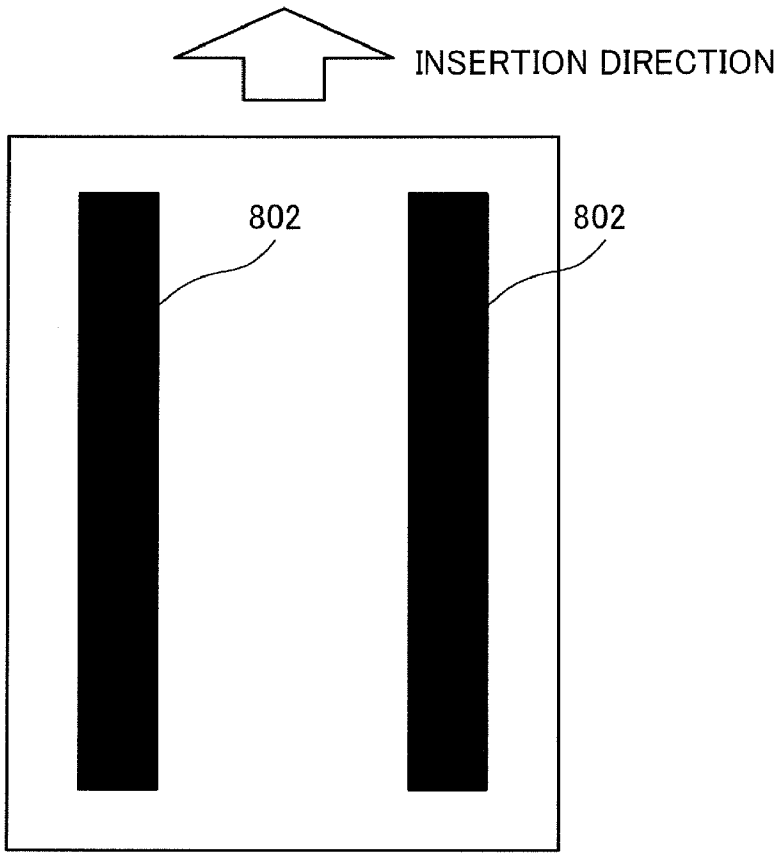
FIGS. 8A and 8B are images with which wrinkles are more likely to occur.
Figure 8A:
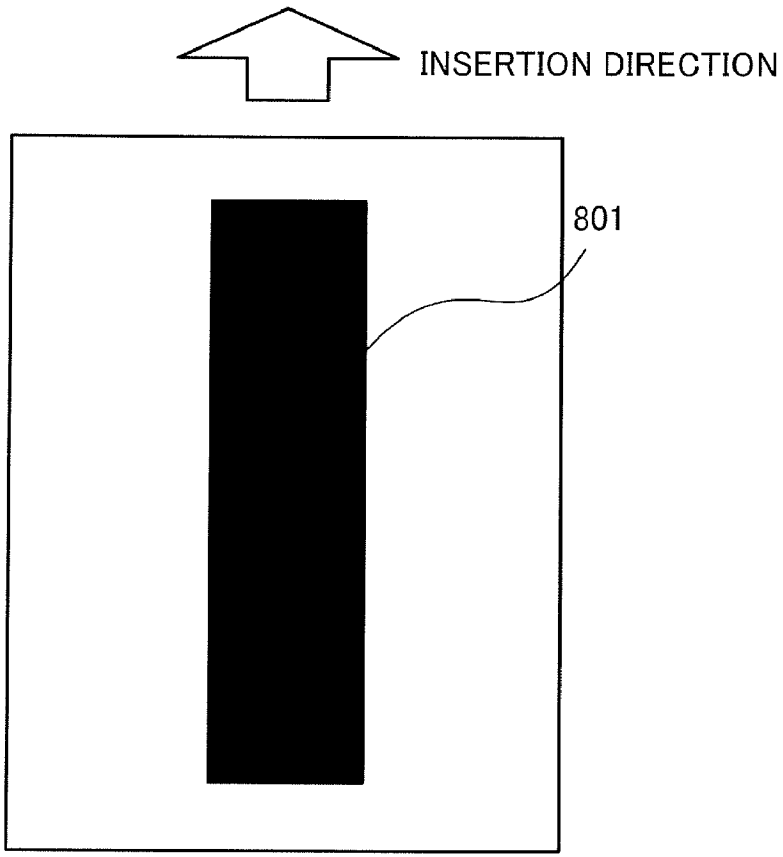

The images shown in FIGS. 8A and 8B are used as images with which wrinkles are more likely to occur when a paper sheet is transported through the fixing device.

The image shown in FIG. 8A is A3 in size, and is an image (with a concentration of 300%) in process black (C (cyan), M (magenta) and Y (yellow) each with a concentration of 100%) formed near a central portion 801 when seen from the insertion direction of the paper sheet into the fixing device. The image shown in FIG. 8B is also A3 in size, and is an image in process black formed near each of edge portions 802 when seen from the insertion direction of the paper sheet into the fixing device. Both of the images have different water contents and the like in the central portion and the edge portions, and, hence, wrinkles are likely to occur.

In addition, in order to create a condition in which wrinkles are further likely to occur, conditioning of the paper sheet used for the experiment is performed under a high temperature and humidity (35 degrees C., 85%) for 12 hours. Then, the experiment is performed.

[Pressure Distributions in Roll Nip Portion N1 and Peeling Pad Nip Portion N2]

The experiment is performed by employing the following two kinds of pressure distributions as the pressure distribution in the roll nip portion N1.

The first pressure distribution has a pattern in which the pressure increases from the central portion of the fixing belt 610 to each of the edge portions thereof in the axial direction (i.e. a case in which the edge portions are pressed more strongly than the central portion in the axial direction, the distribution being referred to as "pressure distribution PA" hereinafter). The next pressure distribution has a pattern in which the pressure is approximately uniform from the central portion to each of the edge portions in the axial direction (i.e. a case in which the central portion and the edge portions in the axial direction are pressed with the same pressure, the distribution being referred to as "pressure distribution PB" hereinafter). Here, the pressure distribution PA may be obtainable by using the pressure roll 62 having a flared shape with the radius of each of the side portions being larger than that of the central portion by 200 μm, while the pressure distribution PB may be obtainable by using the pressure roll 62 having a straight shape.

The experiment is performed by employing the following three kinds of pressure distributions as the pressure distribution in the peeling pad nip portion N2.

The first pressure distribution has a pattern in which the pressure increases from the central portion of the fixing belt 610 to each of the edge portions thereof in the axial direction (i.e. a case in which the edge portions are pressed more strongly than the central portion in the axial direction, the distribution being referred to as "pressure distribution (1)" hereinafter). The next pressure distribution has a pattern in which the pressure is approximately uniform from the central portion of the fixing belt 610 to each of the edge portions thereof in the axial direction (i.e. a case in which the central portion and the edge portions in the axial direction are pressed with the same pressure, the distribution being referred to as "pressure distribution (2)" hereinafter). The last pressure distribution has a pattern in which the pressure decreases from the central portion of the fixing belt 610 to each of the edge portions thereof in the axial direction (i.e. the distribution being referred to as "pressure distribution (3)" hereinafter).

The pressure distribution (1) may be obtained by using the peeling pad 64 having a concave shape with the pressing face being curved by 300 μm in the axial direction (i.e. a shape in which the central portion, compared to the edge portions, is distant from the pressing surface). The pressure distribution (2) maybe obtained by using the peeling pad 64 having a straight shape, and the pressure distribution (3) may be obtained by using the peeling pad 64 having a convex shape with the pressing face being curved by 400 μm in the opposite direction as that for the pressure distribution (1) (i.e. a shape in which the edge portions, compared to the central portion, are distant from the pressing face). Here, the pressing face of the peeling pad 64 for the pressure distribution (2) has a straight shape in a non-pressing state while having a shape being curved approximately 50 μm in a pressing state.

The paper sheet for the experiment of each kind is transported through the fixing device under each of the six conditions defined by combinations of each of the pressure distributions PA and PB and each of the pressure distributions (1) to (3), to perform visual evaluations of whether or not wrinkles occur on the paper.

Figure 9:
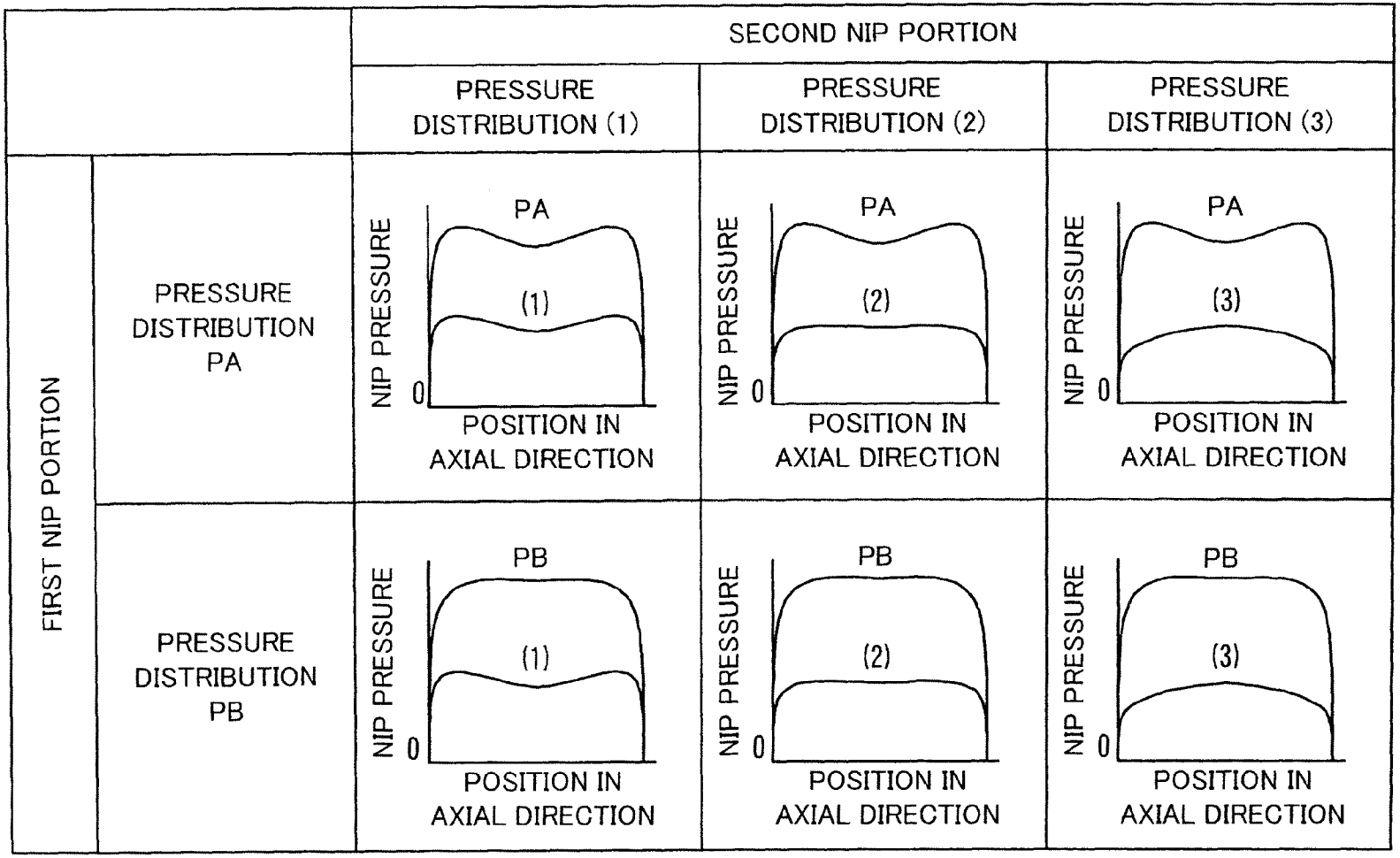
FIG. 9 is a table summarizing the combinations.

FIG. 9 is a table summarizing the combinations. The views in the table schematically show all the combinations of each of the pressure distributions PA and PB and each of the pressure distributions (1) to (3). The horizontal axis and the vertical axis in each of the views show a position in the fixing belt 610 in the axial direction, and the nip pressure, respectively, as in the case shown in FIG. 6.

[Experimental results]

The experimental results are shown in table 1 below.

TABLE 1

| PAPER SHEET | | (1) | (2) | (3) |
|---|---|---|---|---|
| OK TOPKOTE N PAPER | PA | X | X | Y |
| | PB | Z | Z | Z |
| ST PAPER | PA | X | X | Y |
| | PB | Z | Z | Z |

In table 1, X denotes that no wrinkles occurred; Y denotes that wrinkles partly occurred; and Z denotes that wrinkles occurred entirely.

The results in table 1 show that occurrence of wrinkles is prevented, for both the OK Topkote N paper and the ST paper, under the following conditions: the pressure distribution in the roll nip portion N1 has the pattern in which the pressure increases from the central portion of the fixing belt 610 to each of the edge portions thereof in the axial direction (i.e. the pressure distribution PA) while the pressure distribution in the peeling pad nip portion N2 has the pattern in which the pressure increases from the central portion of the fixing belt 610 to each of the edge portions thereof in the axial direction (i.e. the pressure distribution (1)) or the pattern in which the pressure is approximately uniform from the central portion of the fixing belt 610 to each of the edge portions thereof in the axial direction (i.e. the pressure distribution (2)).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing roll that is rotatable;

a belt member that is stretched by the fixing roll;

a pressure roll that presses the fixing roll through the belt member; and a peeling member that presses an outer surface of the belt member against the pressure roll, wherein the pressure roll presses the belt member with pressure at an edge portion of the belt member larger than pressure at a central portion of the belt member in an axial direction, and the peeling member presses the belt member with pressure at the edge portion of the belt member equal to or larger than pressure at the central portion of the belt member in the axial direction, wherein the fixing roll has a same radius from the central portion to the edge portion in the axial direction, and the pressure roll has a larger radius at the edge portion than a radius at the central portion in the axial direction.

2. The fixing device according to claim 1, wherein the peeling member has a portion for pressing the belt member, the portion being in a concave shape in an axial direction.

3. The fixing device according to claim 1, wherein the fixing roll is a hard roll and the pressure roll is a soft roll.

4. The fixing device according to claim 1, wherein the pressure roll is covered with an elastic body, and an elastic modulus of the elastic body is larger in the edge portion than in the central portion in an axial direction of the pressure roll.

5. An image forming apparatus comprising:

a toner image forming unit that forms a toner image;

a transfer unit that transfers the toner image to a recording medium; and a fixing unit that fixes the toner image on the recording medium, wherein the fixing unit includes:

a pressure roll pressing a fixing roll through a belt member, and thereby forming a first nip portion in which pressure increases from a central portion of the belt member to an edge portion of the belt member in an axial direction; and a peeling member pressing an outer surface of the belt member against the pressure roll on a downstream side of the first nip portion, and thereby forming a second nip portion in which pressure is uniform, or increases, from the central portion of the belt member to the edge portion of the belt member in the axial direction, wherein the fixing roll has a same radius from the central portion to the edge portion in the axial direction, and the pressure roll has a larger radius at the edge portion than a radius at the central portion in the axial direction.

6. The image forming apparatus according to claim 5, wherein the peeling member is provided so that pressure in a region between the first nip portion and the second nip portion decrease from pressure in the first nip portion to pressure in the second nip portion, in a movement direction of the belt member.

7. The image forming apparatus according to claim 5, wherein the peeling member has a portion for pressing the belt member, the portion being in a concave shape in an axial direction.

8. A fixing method of a fixing device including a fixing roll that is rotatable; a belt member that is stretched by the fixing roll; a pressure roll that presses the fixing roll through the belt member; and a peeling member that presses an outer surface of the belt member against the pressure roll, the fixing method comprising:

pressing the belt member with pressure at an edge portion of the belt member larger than pressure at a central portion of the belt member in an axial direction when the belt member is pressed by the pressure roll;

pressing the belt member with pressure at the edge portion of the belt member equal to or larger than pressure at the central portion of the belt member in the axial direction when the belt member is pressed by the peeling member; and causing a recording medium having a toner image to pass through a portion between the pressure roll and the belt member and fixing the toner image onto the recording medium, wherein the fixing roll has a same radius from the central portion to the edge portion in the axial direction, and the pressure roll has a larger radius at the edge portion than a radius at the central portion in the axial direction.

9. The fixing method according to claim 8, wherein the peeling member has a portion for pressing the belt member, the portion being in a concave shape in an axial direction.

10. The fixing method according to claim 8, wherein the fixing roll is a hard roll and the pressure roll is a soft roll.

11. The fixing method according to claim 8, wherein the pressure roll is covered with an elastic body, and an elastic modulus of the elastic body is larger in the edge portion than in the central portion in an axial direction of the pressure roll.

* * * * *